United States Patent [19]

Laapotti

[11] Patent Number: 4,976,821

[45] **Date of Patent: * Dec. 11, 1990**

[54] PRESS SECTION WITH SEPARATE PRESS ZONES IN A PAPER MACHINE

[75] Inventor: Jorma Laapotti, Palokka, Finland

[73] Assignee: Valmet Oy, Finland

[ * ] Notice: The portion of the term of this patent subsequent to Jun. 5, 2007 has been disclaimed.

[21] Appl. No.: 427,740

[22] Filed: Oct. 26, 1989

Related U.S. Application Data

[63] Continuation of Ser. No. 190,470, May 5, 1988, abandoned, Continuation-in-part of Ser. No. 735,782, May 20, 1985, abandoned.

[30] Foreign Application Priority Data

May 25, 1984 [FI] Finland ..... 842114

[51] Int. Cl.[5] ..... D21F 3/04

[52] U.S. Cl. ..... 162/360.1; 162/306; 162/359

[58] Field of Search ..... 162/305, 306, 358, 359, 162/360.1

[56] References Cited

U.S. PATENT DOCUMENTS

| | | | |
|---|---|---|---|
| 4,224,372 | 9/1980 | Romanski | 162/DIG. 1 |
| 4,483,745 | 11/1984 | Wicks et al. | 162/360.1 |
| 4,526,655 | 7/1985 | Karrinen et al. | 162/360.1 |
| 4,704,192 | 11/1987 | Cronin | 162/358 |

FOREIGN PATENT DOCUMENTS

| | | | |
|---|---|---|---|
| 3515576 | 11/1985 | Fed. Rep. of Germany | 162/358 |
| 3604522 | 11/1986 | Fed. Rep. of Germany | 162/358 |

*Primary Examiner*—Karen M. Hastings
*Attorney, Agent, or Firm*—Steinberg & Raskin

[57] ABSTRACT

A press section in a paper machine includes, in the direction of web run, two successive, separate press nips for dewatering a web, the web passing between the nips in a closed draw. The first nip is formed between two, preferably hollow-faced, press rolls. The press section includes a first fabric which picks up the web from the forming wire. The press section comprises at least three fabrics of which one acts as a press fabric in the first press nip and another acts as a press fabric and/or as a transfer fabric both in the first as well as in the second nip. The web is transferred from the last press nip of the press section to the drying section. The last press nip is formed by an extended-nip press and has a nip zone with a length substantially longer than the length of the press zone of the preceding roll nip. The web runs through the nip zone of the extended-nip press so that it is supported on one side by a substantially non-water receiving transfer fabric, the other side of the web being pressed by a water-receiving press fabric. The web is substantially immediately detached from the water-receiving press fabric after passing through the extended nip zone and is passed to the drying section.

19 Claims, 3 Drawing Sheets

PRESS SECTION WITH SEPARATE PRESS ZONES IN A PAPER MACHINE

CROSS-REFERENCE TO RELATED APPLICATIONS

This is a continuation, of application Ser. No. 190,470, filed May 5, 1988 now abandoned, which in turn is a CIP of Ser. No. 735,782, filed May 20, 1985, now abandoned.

BACKGROUND OF THE INVENTION

The present invention relates generally to paper making and more particularly, to the construction of a press section of a paper machine.

The press section is particularly directed to improvements in press sections which include, in the direction of web passage through the press section, two successive, separate dewatering press nips between which the web travels in a closed draw. The first one of the separate press nips is formed between two preferably hollow-faced press rolls. The press section includes a first fabric, which functions as a pick-up fabric onto which the web is transferred from the forming wire and, in total, the press section includes at least three fabrics arranged so that one of the fabrics acts as a press fabric in the first nip and a second fabric acts as a press and/or transfer fabric both in the first nip as well as in the second nip. The web is transferred after the last press nip to the drying section as a closed draw.

Dewatering of a paper web by evaporation consumes large amounts of energy and is therefore a costly and uneconomical operation. For this reason, it is usually attempted to remove as much water as possible from the web by mechanical means before the web reaches the drying section of the paper machine. The last stage where water is mechanically removed from the web in a paper machine is the press section where water is removed by pressing the web between rolls. It is well-known that water will be more readily removed from the web when the temperature of the water is elevated since the viscosity of the water and the springback coefficient or coefficient of compression elasticity of the web are thereby reduced as is the surface tension.

As the rates of production of paper machines increase, one of the major bottle-necks which will limit further increased production rates is the existence of open draws of the web after the press section, either from the press section to the drying section or in the first free spaces in the drying section itself.

The most common conventional arrangement for dewatering fibrous webs, in particular paper and cardboard webs, is one where the web is passed through a press nip formed between two rolls situated in facing relationship to each other.

As is well known, one or two press fabrics are used in such dewatering nips, the fabrics carrying the water drained from the web away from the nip and also functioning to carry the web forwardly after the press nip.

If it is attempted to increase the dewatering capacity of a nip press by increasing the nip pressure, a certain line pressure is eventually reached beyond which any increase in the nip pressure is no longer desirable since the structure of the web and the press fabrics cannot withstand such increased compression pressures.

The dewatering capacity of a nip press can be increased by lengthening the zone of the roll nips through the use of larger diameter rolls and softer press fabrics.

However, a limit is again reached using even this technique. Conventional nips which use press-suction rolls are also limited by the common requirement that the press-suction roll have a variable-crown arrangement. However, it is not usually possible to provide a press-suction roll with a variable-crown due to the perforations in the mantle of the suction roll and/or since the interior of the press-suction roll is occupied by suction equipment to the extent that the space available for variable-crown equipment is not insufficient.

Accordingly, for these and other reasons, so-called extended-nip presses have recently been proposed. In this connection, reference is made, by way of example, to U.S. Pat. Nos. 3,808,092; 3,808,096; 3,840,429; 3,970,515; 4,201,624; and 4,229,253, to G.B. Pat. Appl. No. 20 57 027, as well to Finnish Patent Applications Nos. 82-3500; 83-0995; and 83--1028, the Finnish Applications being assigned to the assignee of the instant application.

SUMMARY OF THE INVENTION

It is an object of the present invention to provide a new and improved press section in a paper machine which has two successive, separate dewatering press nips in the direction of web run through the press section, between which the webs travel as a closed draw.

Another object of the present invention is to provide a new and improved open press section, i.e. a press section having at least two separate press nips, by means of which a high dry solids content can be obtained for the web utilizing only two nip zones so that the press section is suitable for use in the production of thin paper qualities, such as newsprint.

Still another object of the present invention is to provide a new and improved open press section by means of which a paper or board web having improved symmetry in the direction of thickness thereof is obtained.

A further object of the present invention is to provide a new and improved open press section by means of which relatively thin and low-weight paper qualities, e.g., having a grammage range of between about 20 to $80g/m^2$, can be obtained.

A still further object of the present invention is to provide a new and improved open press section wherein the problem of rewetting the web after a press nip is eliminated or substantially reduced.

Briefly, in accordance with the present invention, these and other objects are attained by providing an open press section having two separate successive press nips and wherein, the last separate press nip in the press section is an extended-nip press, the length of the nip zone of which is substantially larger than the length of the nip zone in the preceding roll nip, the extended-nip press is arranged so that the web passes through the nip zone with one of its sides supported by a substantially non-water receiving transfer fabric, while the other side of the web is pressed by a water-receiving press fabric, and the web is detached from the water-receiving press fabric immediately after the extended-nip zone and is preferably passed as a closed draw to the drying section on the face of the substantially non-water receiving fabric.

More specifically, the present invention is directed to a press section of a paper machine, comprising one pick-up roll, three press rolls, a plurality of fabric guiding rolls, one press shoe, and three pressing fabrics. There is also a dense compression belt. Two, and only two, press nips in the section have respective nip zones for removing water from a web running through the nips in the press section. A first one of the press nips in a direction of run of the web through the press section, is formed between two of the three press rolls, while a second one of the nips is formed between the shoe and a third one of the press rolls, and constitutes an extended nip with the nip zone thereof being substantially longer than length of the nip zone of the first press nip.

A first one of the three pressing fabrics passes through the first nip, a second one of the three fabrics passes through the first and second nips, a third one of the three fabrics passes through the second nip, and the dense compression belt passes within a loop formed by one of the three fabrics. The rolls, nips, fabrics and belt are arranged to transport the web in a closed draw on the second fabric from the first nip to the second nip, and to detach the web substantially immediately after the second nip from a water-receiving fabric to prevent re-wetting of the web after the second nip.

Preferably, two of the three fabrics are water-receiving press fabrics, with the remaining fabric thereof being a substantially non-water receiving fabric. The rolls, nips, fabrics and belt are also preferably arranged to transport the web in a closed draw on one of the second or third fabrics from the second nip to a drying section of the paper machine. In particular, the second or third fabric arranged to transport the web in the closed draw from the second nip to the drying section, is the substantially non-water receiving fabric, passes through the second nip supporting one side of the web, has a permeability considerably lower than the permeability of the other two water-receiving fabrics, and constitutes means for transferring the web as the closed draw to the drying section substantially immediately after passing through the second nip. Furthermore, one of the water-receiving fabrics passes through the second nip and is pressed against an opposite side of the web from the substantially non-water receiving fabric.

A press section in accordance with the present invention provides a fully closed draw of the web, thereby reducing the risk of web breaks and enables the paper machine to be operated at high running speeds. The closed draw also facilitates the capacity of the press section to obtain thin paper qualities, which are inherently weak and therefore tend to be broken.

The high dry solids content of the web obtained by means of a press section in accordance with the present invention is also energy economical in that the specific consumption of energy attributed to dewatering by means of compression is considerably less than the energy required for dewatering by means of evaporation. The advantages provided by a press section in accordance with the invention can also be utilized in the form of increased production since the press section provides the capability of increased running speeds.

The use of an extended-nip press in a press section in accordance with the invention enables the web to be dewatered in a manner such that its symmetry is preserved, since the wide nip zone provided by the extended nip enables an efficient dewatering to be accomplished in a relatively gentle manner.

In embodiments of the invention wherein a substantially non-water receiving transfer fabric constitutes one of the fabrics in the extended-nip press, the web is detached from the other water-receiving press fabric which passes through the extended-nip zone immediately after the nip zone, and the web is transferred on the transfer fabric as a closed draw to the drying section. In this matter, rewetting of the web is efficiently prevented.

BRIEF DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

The embodiments of a press section according to the invention described below are illustrated in schematic form without the associated frame construction. The frame construction is conventional and can be similar to that described in application Ser. No. 531,297 filed Sept. 12, 1983, now U.S. Pat. No. 4,526,655, assigned to the same assignee as the instant application.

Figure 1:
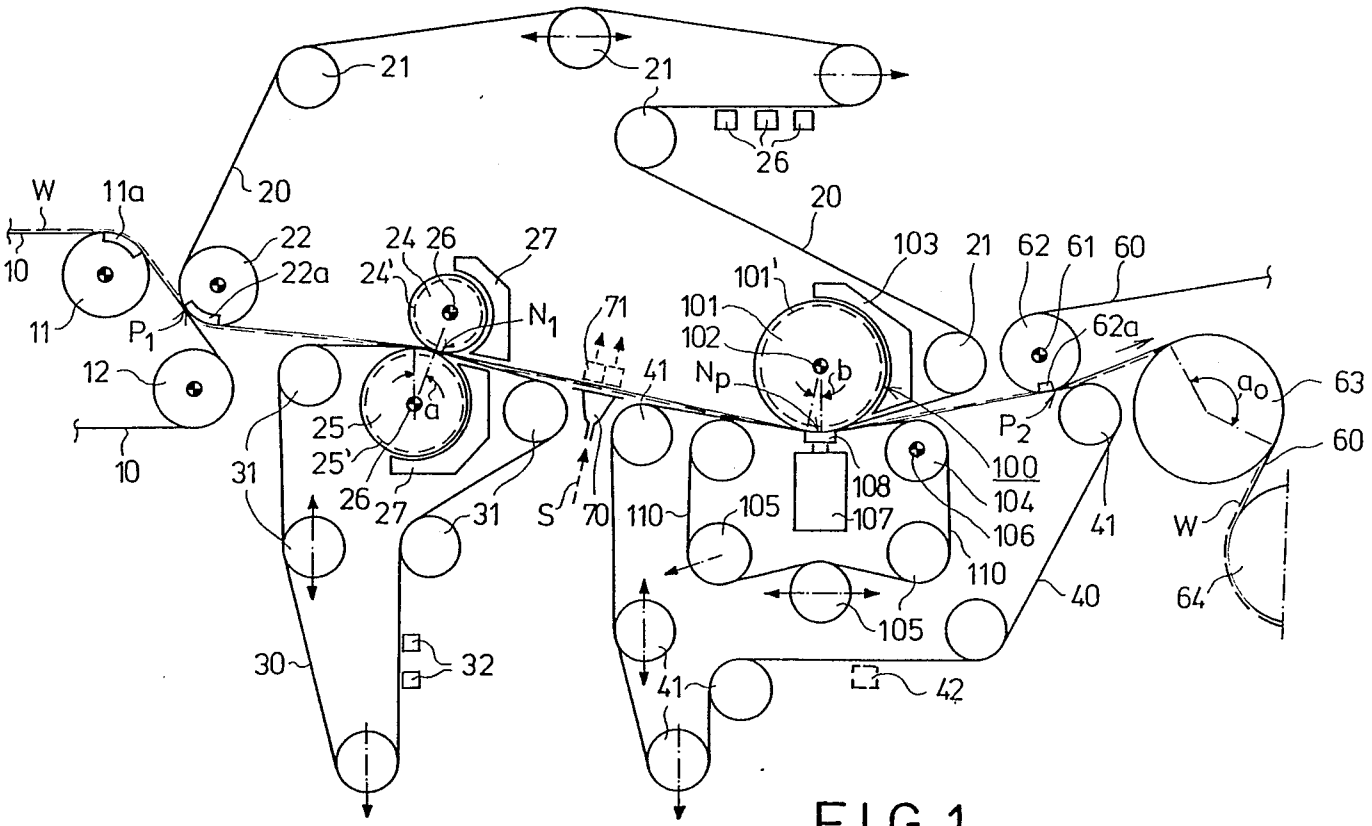
FIG. 1 is a schematic elevational view of one embodiment of a press section in accordance with the present invention.
Figure 2:
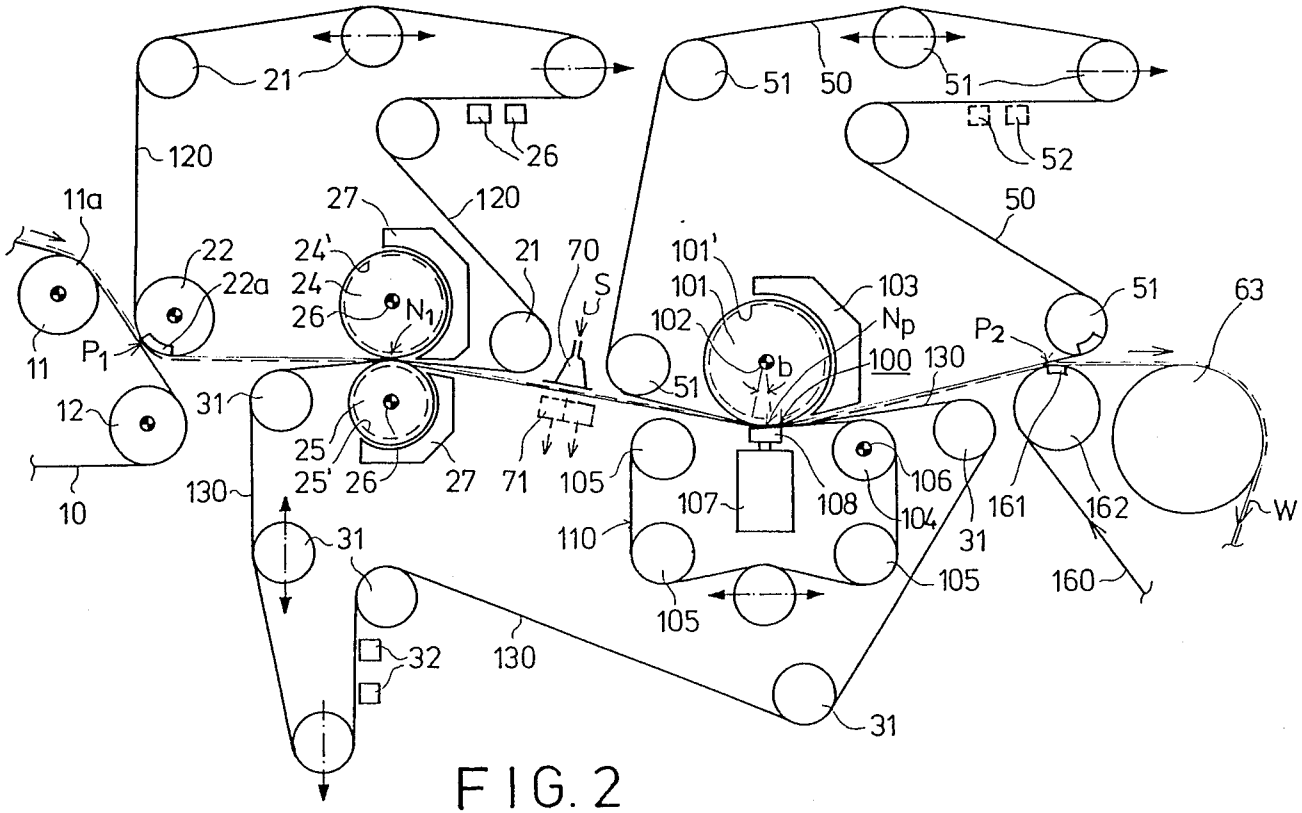
FIG. 2 is a schematic elevational view of a second embodiment of a press section in accordance with the invention.

Referring now to the drawings wherein like reference characters designate identical or corresponding parts throughout the several views, and more particularly to the embodiments illustrated in FIGS. 1 and 2, the web W is formed on a forming wire 10, which is either a Fourdrinier wire or a carrying wire of a twin wire former. The web W is detached from the wire 10 at the detachment line $P_1$ within a suction zone 22*a* of a pick-up roll 22 and located on a downwardly slanting run of the wire 10 between a suction zone 11*a* on a suction roll 11 and a drive roll 12. The web is transferred onto the bottom surface of the first upper fabric 20;120 which functions both as a water-receiving press fabric as well as a pick-up fabric. The guide rolls of the first upper fabric 20;120 are designated by reference numeral 21 and fabric reconditioning devices are designated by numeral 26.

The web is carried on the lower surface of fabric 20;120 into the first press nip $N_1$ formed between press rolls 24 and 25 which have hollow faces 24', and 25' respectively. Hollow faces may be formed, for example, from radial grooves, blind-drilled holes or most preferably by a spiral-groove coating band wound around the roll. The first press nip $N_1$ is provided with two press fabrics, namely the first upper fabric 20;120 and a first lower fabric 30;130, the latter also being a water-receiving fabric. The guide rolls of fabric 30;130 are designated by numeral 31 and a fabric reconditioning device is designated by numeral 32. One or both of the press rolls 24 and 25 may be variable-crown rolls, if necessary. The hollow face 24', 25' of the press rolls 24, 25 may be hard or soft and the rolls are provided with drive units 26 as well as with water-collecting troughs 27.

One of the press rolls 24, 25 may be a press-suction roll although the use of such a roll involves the drawbacks mentioned above. Dewatering takes place through both faces of the web W in the first press nip $N_1$, i.e., both into the upper fabric 20;120 and into the lower fabric 30;130. This at least partially guarantees a symmetric and yet gentle initial dewatering of the web.

In the following description, the fabrics which run through the first press nip $N_1$ are designated first fabrics. Thus, in the embodiment of FIG. 1, fabrics 20 and 30 are the first fabrics, while in the embodiment of FIG. 2, the fabrics 120 and 130 are first fabrics.

Referring to FIG. 1, the first fabric 20 is a water-receiving fabric and acts as an upper press fabric both in the first roll nip $N_1$ as well as in the extended nip $N_p$. The press section includes a second fabric 40 passing through the extended nip $N_p$ and about guide rolls 41, with numeral 42 denoting a reconditioning device. Fabric 40 is a substantially non-water receiving transfer fabric by means of which the web is transferred from the press section to the drying section in a closed draw.

Referring to FIG. 2, the first fabric 130 is a water-receiving fabric and acts as a water-receiving fabric in both the roll nip $N_1$ and the extended nip $N_p$. The press section includes a second fabric 50 which is substantially non-water receiving and passes about guide rolls and suction rolls 51, with numeral 52 denoting reconditioning devices. The fabric 50 acts as an upper fabric in the extended nip $N_p$ by means of which the web W is transferred as a closed draw from the press section to the drying section. Alternatively, in the case where extremely thick and strong paper webs are being produced, the second fabric 50 may also be water-receiving, with the web being passed to the drying section as an open draw.

In other words, the last, extended nip removes water from fairly thick corrugated medium, in both directions. In such a press section in question, there is no closed draw to the drying section after the extended nip press. Rather, the web is pulled off after the nip from one of the press felts, usually from the lower felt, and is transferred as an open draw to the drying section. This is feasible, because the web is extremely strong, and the speed is fairly low.

Although a conventional tandem felt may be used in the press section in question, the web transfer and rewetting present no tremendous problems because the web is extremely heavy and the rewetting is rather insignificant in relation to the base weight of the strong corrugated web. In contrast, in the case of thin paper grades, it is uneconomical to use a conventional tandem felt for rewetting reasons. Furthermore, a thin paper cannot be caused to reliably follow the second conventional press felt after the second nip at all times, for the purpose of transfer to the drying section.

Figure 3:
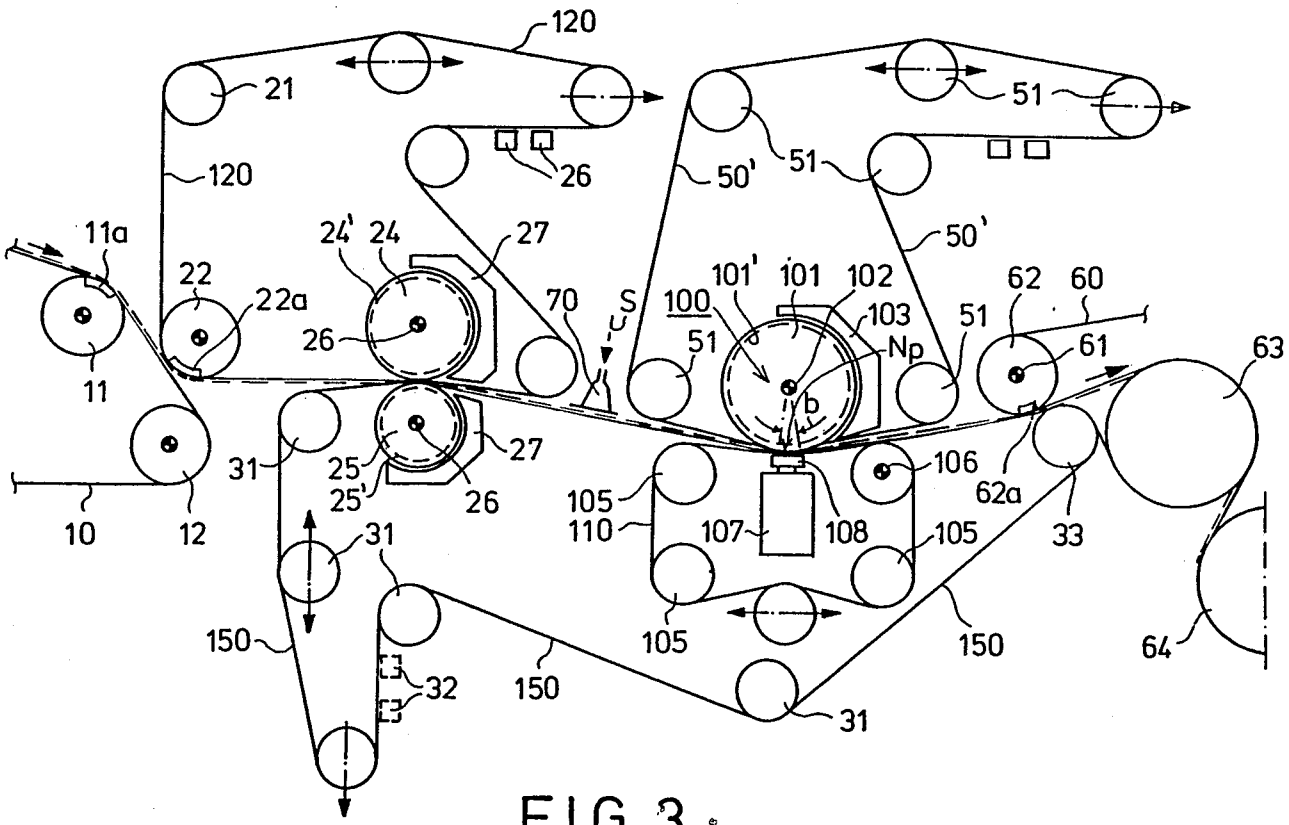
FIG. 3 is a third embodiment of a press section in accordance with the invention and wherein a closed draw of the web from the press section to the drying section is accomplished in a manner similar to the FIG. 2 embodiment.

Referring to FIG. 3, the press section is similar to that illustrated in FIG. 2. The water-receiving fabric 130 of the press section of FIG. 2, is replaced by a substantially non-water receiving fabric 150 on which the web W is transferred as a closed draw at transfer roll 33 from the press section to the drying section as seen in FIG. 3, by using an arrangement similar to that shown in FIG. 1. It is also preferable to replace the substantially non-water receiving fabric 50 of the press section shown in FIG. 2 by a corresponding water-receiving fabric 50, such as a press felt. In the press section of FIG. 3, the run of the substantially non-water receiving fabric 150 is, in other respects, similar to the run of the dewatering fabric 130 of the press section shown in FIG. 2.

An important feature of the present invention is in the provision of an extended-nip press 100 separate from the first press nip $N_1$.In the extended-nip $N_p$, the paper web W is pressed against a counter-roll 101 by means of a press shoe 108. Due to the high loads in the extended nip $N_p$, the roll 101 is preferably a variable-crown roll. The counter-roll 101 is provided with a hollow face 101' and a drive unit 102, with numeral 103 denoting a water-collecting trough (saveall).

In the press section shown in FIG. 1, the upper fabric that passes through the nip zone b is a press felt 20 while the lower fabric passing through nip zone b is a transfer fabric 40 arranged in such a way that the web is detached from the upper felt 20 immediately or as soon as possible after the nip $N_p$ and transferred to the drying section supported on the transfer fabric 40. In the press section shown in FIG. 3, within the nip zone b of the extended nip $N_p$, the lower fabric is a substantially non-water receiving fabric 150 that also runs through the first separate roll nip $N_1$ and which additionally transfers the web as a closed draw from the last nip $N_p$ onto a fabric 60 of the drying section in substantially the same manner as the fabric 40 carries the web W to the drying section in the case of the press section in FIG. 1. The embodiment shown in FIG. 3 differs from that shown in FIG. 2 in that the fabric 150 is a substantially non-water receiving fabric and carries the web as a closed draw to the drying section whereas the water-receiving fabric 130 runs through both of the press nips $N_1$ and $N_p$ in FIG. 2.

As noted above, a difference between the embodiments of the press section shown in FIGS. 2 and 3 is that in the embodiment shown in FIG. 3, the fabric 50' is a water-receiving fabric from which the web W is detached substantially immediately after the zone b of the extended nip $N_p$, whereas in the embodiment of FIG. 2, the fabric 50 is a substantially non-water receiving fabric on which the web W is carried as a closed draw to the drying section.

In the embodiment of FIG. 2 the web W is detached from the lower press felt 130 as soon as possible after the nip zone b so that the web W follows along with the transfer fabric 50 carried on the bottom face thereof as a closed draw to the drying section. Alternatively, in the case where extremely thick and strong paper webs are being produced, e.g. in board machines, the web may be passed as an open draw from the nip zone b to the drying section.

The first press nip $N_1$ of the embodiment of FIG. 1 is a so-called inclined nip i.e., a plane containing the axes of the press rolls 24 and 25 is inclined at an angle a relative to a vertical plane.

Referring to the extended nip press 100, the compression pressure of the shoe 108 is applied to the web W through the fabric 40;130;150 by means of a dense compression belt 110 formed, for example, of dense plastic, rubber or metallic material. The belt 110 is guided by guide rolls 104 and 105, roll 104 being provided with a drive unit 106. The press shoe 108 is supported by a beam 107 which may be stationary and possibly provided with a variable-crown. The compression pressure in the nip $N_p$ is produced by means of conventional loading devices such, for example, as hydraulic loading devices applied to the press shoe 108.

The press shoe 108 may be a so-called hydrodynamic shoe or a so-called hydrostatic shoe, or may comprise a combination of both, and is preferably stationary.

Lubrication oil or the like is introduced onto the impervious compression belt 110 at the inlet side of the extended nip $N_p$. Accordingly, the impervious belt 110 should be located precisely beneath the web W as the latter runs through the nip $N_p$ in order to prevent splashing of lubricant onto the web W which would spoil the web.

The basic construction of extended-nip presses, such as the press 100, is generally known. However, reference is made to the extended-nip press disclosed in a Ser. No. 590,951 filed Mar. 19, 1984 now U.S. Pat. No. 4,576,682 and assigned to the same assignee as the instant application, wherein an extended-nip press is disclosed, the details of which may be applied in connection with the extended-nip press 100. The disclosure of application Ser. No. 590,951 is incorporated by reference.

In the first press nip $N_1$, one of the press rolls 24 (FIG. 1), 25 (FIGS. 2 and 3) is preferably a variable-crown roll having a diameter in the range of between about 700 to 900 mm. The other press roll 25 (FIG. 1), 24 (FIGS. 2 and 3) is a rigid roll having a diameter in the range of between about 1100 to 1400 mm. The counter-roll 101 in the nip $N_p$ may be a variable-crown roll having a diameter in the range of between about 1000 to 1400 mm., or a rigid roll having a diameter in the range of between about 1500 to 1800 mm. The width of the press shoe 108, i.e. the width of the nip zone b, is generally on the order of between about 15 to 25 cm., preferably about 20 cm.

In the embodiment of FIG. 1, the substantially non-water receiving transfer fabric 40 carries the web W after the extended nip $N_p$ onto a transfer suction roll 62 having a drive unit 61 over the suction zone **62*a* of which the drying wire 60 of the drying section is passed. The web is shifted at the line $P_2$ from the transfer fabric 40 onto the drying wire 60 under the effect of the suction zone 62*a*. The web W adheres to the face of the drying wire 60 and is passed over the first drying cylinder 63 or baby cylinder in the drying section over a sector $a_o$. The web W runs through at least the initial part of the drying section supported on the drying wire 60, preferably as a so-called single wire draw. Numeral 64** denotes a second cylinder in the drying section.

The closed draw of the web W through the entire press section and to the drying section provided by the embodiments of the invention of FIGS. 1–3 is also advantageous in that even if a drying wire 60 or corresponding transfer fabric is used which has a seam, such a seam will not leave a mark in the web because the transfer suction roll 62;162 (having a suction zone 161) operates on a yielding straight run of the transfer fabric 40; 50; 150, and not against a hard roll face.

In the embodiments of FIGS. 1–3, a steam box 70 is situated between the first and second nips $N_1$ and $N_p$ and supplies steam S against the web W. A suction box 71 (FIGS. 1 and 2) may be placed on the opposite side of the web-carrying fabric. The function of the one or more steam boxes 70 is to increase the dry solids content of the web in that after the application of the steam S from the box 70, more water can be removed from the web due to the reduction in viscosity of the water on the one hand, and due to the reduction in the springback coefficient on the other hand, both of which phenomena are a result of the higher temperature at which compression takes place.

It is seen from the foregoing that a web passes in a fully closed draw through a press section in accordance with the invention between the points $P_1$ and $P_2$. In other words, the web W is at all times supported on a fabric face and there are no unsupported or open passages of the web W. This feature increases the reliability of operation of the press section by reducing the risk of web break.

In the embodiments of the press section shown in FIGS. 1 and 2, dewatering the first press nip $N_1$ preferably takes place in both directions, i.e., through both faces of the web W. This increases the symmetry of the web W.

An important feature of the invention, in addition to the provision of the extended nip $N_p$ of the extended-nip press 100, is the use of the substantially non-water receiving transfer fabric 40;50;150 which also transfers the web W as a closed draw to the drying section. In the following discussion, reference is made only to the transfer fabric 50 and it will be understood that the description is equally applicable to the fabrics 40 and 150.

The non-water receiving property of fabric 50 generally implies, although not necessarily, that the transfer fabric 50 is relatively impervious. The transfer fabric is, for example, a fabric produced by impregnating an ordinary press felt with an appropriate plastic material. In some applications, the transfer fabric 50 may be, to some extent, pervious and/or water receiving. In the present invention, the term "transfer fabric" means a fabric or band in general whose permeability (perviousness to air) is within the range of about 0 to 2.0 $m^3/m^2min$, when the difference in pressure $\Delta p = 10$ mm. $H_2O$ (water column), considerably lower than the permeability of ordinary water-receiving press felts. Thus, the perviousness to air of a normal new press felt is generally within the range of between about 10 to 30 $m^3/m^2 \times min$. The perviousness to air of a normal used press felt is generally about 5 $m^3/m^2 \times min$. at the same pressure difference. Under the circumstances, and in view of the fact that the transfer fabric 50 is substantially non-water receiving, it is also advantageous that the transfer fabric be relatively dense and impervious with its permeability being considerably lower than the permeability of ordinary water-receiving press felts, i.e. considerably lower than 5 $m^3/m^2 \times min$.

Furthermore, concerning the composition of the substantially non-water receiving felt itself, numerous trial machine runs which have been conducted, have shown that at least one functioning transfer felt should have a nap-surface fabric structure, similar to a conventional press felt but otherwise having the permeability thereof considerably reduced by treatment with hydrophilic resins. Some degree of permeability has, however, been found to be advantageous for adhesion, transfer, dry matter content, and detachment purposes. More particularly, perviousness-to-air values may be in the range of about 0 to about 2.0 $m^3/m^2min$, most preferably about 0.1 to 0.5 $m^3/m^2min$, when the pressure difference is about 100 Pa, or about 10 mm. $H_2O$. It is also possible for the functioning transfer material to be even totally impervious. The transfer felt functions in its transfer duty as the surface of a granite roll, i.e. being impervious but not, strictly speaking, totally smooth and impor-ous.

In any event, the press structure of the present invention, notably the substantially non-water receiving felts utilized herein, provide distinct, important advantages over the art, e.g., as disclosed in U.S. Pat. No. 4,483,745 to Wicks et al. A slightly pervious transfer felt in accordance with the present invention receives water, to some extent, in the press nip, so that it is possible to produce paper that is more symmetric than when a smooth impervious transfer belt is used, in which case the dewatering will be totally in one direction only. When there is a slightly pervious and water-receiving transfer felt in the nip in place of a smooth, impervious transfer belt, a slightly better dry matter content is achieved in the paper produced. Adhesion and travel of the paper web into the nip are better without any air blow occurring in front of the nip, when a slightly pervious transfer felt is used, than in the case when a smooth, impervious transfer belt is utilized. Furthermore, the paper web can be detached from the surface of a slightly pervious transfer felt by means of a suction device, more easily than from the surface of a smooth, impervious transfer belt.

In U.S. Pat. No. 4,483,745 to Wicks et al, the transfer belt cannot be pervious at all, when an extended nip is used, because the lubricant (oil) would penetrate through the pores of the belt into the paper web. In the present invention, the transfer felt 40;50;150 can indeed be slightly pervious, because the slide or compression belt 110 of the extended nip $N_p$ is separately provided, an important significant advantage over U.S. Pat. No. 4,483,745 to Wicks et al.

The surface properties of the transfer fabric 50 also influence the surface properties of the web W being produced, as well as influencing which particular fabric the web follows after each nip. The transfer fabric 50 may be water-receiving, at least to some extent, especially where thicker paper qualities, e.g., qualities having a grammage on the order of about 100 g/m$^2$, are being produced. As a general rule, the thinner the paper qualities that are being prepared, the denser the transfer fabric 50 must be.

It is possible to use the transfer fabric or band that carries the web to the drying section in lieu of the drying wire 60 to carry the web onto a roll face or fabric therein, so that the web W continues its run in the drying section.

In general, the line pressures in the various nips of a press section in accordance with the invention may be within the following ranges:

$$P_{N1}=50 \text{ to } 100 \text{ KN/m},$$

$$P_{Np}=500 \text{ to } 1000 \text{ KN/m}.$$

Higher line pressures can be used in the press section in accordance with the invention than, for example, in a compact press section, such as the "Sym-Press" press section available from Valmet Oy of Finland, assignee of the instant application, since all of the nips are provided with two fabrics so that in addition to the extended nip $N_p$, the roll nip $N_1$ can have a nip zone which is relatively long. Moreover, the press rolls can have solid mantles, including hollow-faced and in certain cases even smooth mantles, or can be formed of cast iron. Such rolls are more durable and less expensive than the suction rolls having perforated mantles or smooth-faced rock or stone rolls.

In some applications, a press section in accordance with the invention may include two separate extended nips or a group of two extended nips located close to each other in lieu of the single extended nip $N_p$, shown in the illustrated embodiments. Moreover, in the construction of the extended-nip press, instead of using a single counter-roll 101 and a single press shoe 108 or other corresponding compression element, it is possible to use two or more jointly operative rolls or shoes which are in tight contact with each other or at a distance from each other.

A press section in accordance with the invention is also advantageous in that the web W runs as a fully closed draw through the two press nips $N_1$ and $N_p$ p substantially horizontally so that the press nips are substantially in the same horizontal plane and spaced a distance from each other which is sufficient so that the guide rolls from the various fabrics and other equipment, such as steam boxes, can be easily positioned.

Concerning further distinctions and advantages of the present invention over the art, notably U.S. Pat. No. 4,483,745 to Wicks et al, and also G.B. Pat. No. 2,127,448, it is again emphasized that the present invention provides, among other features, an "impervious belt" 110, and a stationary press shoe 108 situated within the loop of the impervious belt 110, neither of which is even remotely suggested in these two references. Furthermore, the present invention specifically utilizes two "belts", i.e. an outer transfer felt 50 which possesses excellent transfer qualities (appropriate for adhesion of the web) so that the web follows therealong reliably after the extended nip $N_p$. Furthermore, as noted above, the transfer felt 50 possessed particular characteristics and improperties so that rewetting of the web W will not occur.

A single belt 15 is used in FIG. 1 of U.S. Pat. No. 4,483,745, and the web W does not follow therealong. The structure shown in FIG. 1 of U.S. Pat. No. 4,483,745 is hardly operable. Also, a single belt 60 is used according to FIG. 3 of this reference, which conducts the web as a closed draw onto a drying wire 64.

However, as pointed out above, the present invention additionally requires another belt 110 which is impervious to oil, with the glide properties (small friction) with the stationary press shoe 108 being good.

In practice, only one belt 60 is used according to the structure shown in FIG. 3 of U.S. Pat. No. 4,483,745. Moreover, this structure is hardly operable since it is virtually impossible, in practice, to integrate into one and the same belt 60, resistance to oil, impermeability, good glide properties (accomplished by belt 110 of the present invention), as well as good transfer and rewetting properties of the web (accomplished by felt 50 of the present invention).

Furthermore, U.S. Pat. No. 4,483,745 only discloses so-called roll nips, which can never have a length as long as a nip having a stationary press shoe 108, as in the present invention. In this regard, it is again pointed out that the second nip $N_p$ of the present invention is formed with a lower press shoe 108, unlike Wicks et al and G.B. No. 2,127,448 where lower rolls are used. A stationary shoe 108 is both less expensive than a press roll, and provides an extended nip $N_p$, in which the residence or dwelling time of the web in the nip $N_p$ is many times longer than in a roll nip, whereby dewatering becomes considerably more effective. Possible deflection compensation of a stationary shoe 108 is simpler to accomplish in a single support beam, than in a corresponding arrangement for a rotating roll. Wicks et al specifically teaches an "extended press type of roll", as disclosed at column 3, lines 36–37 of that reference, totally remote from a press shoe 108 of the present invention as described above.

With the present invention, because of the particular extended nip $N_p$ accomplished by a stationary nip shoe 108 and an impervious belt 110, it is possible to use line pressures that are many times higher, and thus enhance the dewatering action in the last nip. With the present invention, it is possible to use an extremely high compression impulse (pressing time x pressing pressure) in the last extended nip $N_p$, without exceeding the critical maximum pressing pressure ($P_{max}$) per unit area. The maximal pressing pressure ($P_{max}$) per unit area may also be relatively high, since water is already drained in the preceding sharp roll nip, the dry content of the web thus being relatively great when it enters the extended nip $N_p$. As is known, it is the precise removal of the last percentage units of water from the web by pressing, that is the most critical. However, these last percentage units quite significantly affect the amount of drying energy required in evaporation drying, in the drying section following the press section.

Therefore, it is quite clearly seen that the present invention provides certain distinct, important, and surprising improvements over the art, e.g. the exemplary references briefly discussed above.

Numerous modifications and variations of the present invention are clearly possible in light of the above teachings. It is therefore to be understood that the present invention may be practiced otherwise than as specifically disclosed herein.

I claim:

1. A press section of a paper machine, comprising
one pick-up roll,
three press rolls,
a plurality of fabric guiding rolls,
one press shoe,
three pressing fabrics forming fabric loops,
a dense compression belt loop, and
two and only two press nips having respective nip zones for removing water from a web running through said nips in said press section,
a first one of said nips in a direction of run of the web through said press section being formed between two of said three press rolls and a second one of said nips being formed between said shoe and a third one of said press rolls and constituting an extended nip with a nip zone thereof being substantially longer than length of the nip zone of said first press nip, said press shoe being situated within the loop of the dense compression belt,
a first one of said three pressing fabrics passing through said first nip,
a second one of said three fabrics passing through said first and second nips,
a third one of said three fabrics passing through said second nip,
said dense compression belt passing within a loop formed by one of said three fabrics,
wherein said rolls, nips, fabrics and belt are arranged to transport the web in a closed draw on said second fabric from said first nip to said second nip, and to detach the web substantially immediately after said second nip from said second or third fabric which is water-receiving, to prevent re-wetting of the web after the second nip,
wherein two of said three fabrics are water-receiving press fabrics and one fabric thereof is a substantially non-water receiving fabric,
wherein both said substantially non-water receiving fabric and said dense compression belt pass through said second extended nip,
wherein said rolls, nips, fabrics and belt are arranged to transport the web in a closed draw on said substantially non-watering receiving fabric from said second nip to a drying section of the paper machine.

2. The combination of claim 1, wherein said water-receiving fabric passing through said second nip is arranged to be pressed against an opposite side of the web from said non-water receiving fabric.

3. The combination of claim 2, further including a transfer suction roll following said second press nip in the direction of web run,
said transfer suction roll having a suction zone,
a drying wire passing over the transfer suction roll and a first cylinder of a drying section of the paper machine, and
guide roll means for guiding said web-carrying, substantially non-water receiving transfer fabric over a substantially straight run into proximity with said suction zone of said transfer suction roll,
whereby the web is transferred from said transfer fabric onto the drying wire.

4. The combination of claim 2, wherein said transfer fabric is formed of a press belt impregnated with hydrophilic resin.

5. The combination of claim 1 wherein said first pressing fabric additionally passes around said pick-up roll and is one of said two water-receiving fabrics, and
said belt is situated within the loop of said second fabric.

6. The combination of claim 5, wherein said second fabric is the other of said two water-receiving fabrics and said third fabric is said substantially non-water receiving fabric.

7. The combination of claim 6, wherein said first and third fabrics are upper fabric and said second fabric is a lower fabric passing through said respective nips, and
said shoe is situated within the loops of said second fabric and said dense compression belt.

8. The combination of claim 1, wherein said second pressing fabric additionally passes around said pick-up roll and is one of said two water-receiving fabrics, with said first fabric being the other of said two water-receiving fabrics, and said third fabric being said substantially non-water receiving fabric.

9. The combination of claim 8, wherein said second pressing fabric is an upper fabric and said first and third fabrics are lower fabrics passing through said respective nips, and said dense compression belt is situated within the loops of said third fabric,
with said shoe situated in the loops of said third fabric and said dense compression belt.

10. The combination of claim 1, wherein said press rolls of said first press nip comprise hollow-faced rolls.

11. The combination of claim 1, wherein said press shoe is a hydrodynamic or hydrostatic press shoe.

12. The combination of claim 1, wherein in said third press roll forming said second nip with said shoe is an upper press roll and additionally comprising means for driving said upper press roll.

13. The combination of claim 1, wherein the length of said nip zone of said second nip in the direction of web run is in the range between about 15 to 25 cm.

14. The combination of claim 13, wherein the length of said second nip zone in the direction of web run is about 20 cm.

15. The combination of claim 1, wherein said press shoe is supported by a stationary beam.

16. The combination of claim 1, additionally comprising a steam box positioned between said first and second nips to supply steam against the running web.

17. The combination of claim 1, wherein said press nips are structured and arranged such that nip load in said first nip is about 50 to 100 kN/m, and in said second nip about 500 to 1000 kN/m.

18. A press section of a paper machine, comprising
one pick-up roll,
three press rolls,
a plurality of fabric guiding rolls,
one press shoe,
three pressing fabrics forming fabric loops,
a dense compression belt loop, and two and only two press nips having respective nip zones for removing water from a web running through said nips in said press section,
a first one of said nips in a direction of run of the web through said press section being formed between two of said three press rolls and a second one of said nips being formed between said shoe and a third one of said press rolls and constituting an extended nip with a nip zone thereof being substantially longer than length of the nip zone of said first press nip, said press shoe being situated within the loop of the dense compression belt,
a first one of said three pressing fabrics passing through said first nip,
a second one of said three fabrics passing through said first and second nips,
a third one of said three fabrics passing through said second nip,
said dense compression belt passing within a loop formed by one of said three fabrics,
wherein said rolls, nips, fabrics and belt are arranged to transport the web in a closed draw on said substantially non-water receiving fabric from said first nip to said second nip and from said second nip to a drying section of the paper machine, and to detach the web substantially immediately after said second nip from said second or third fabric which is water-receiving, to prevent re-wetting of the web after the second nip,
wherein two of said three fabrics are water-receiving press fabrics and one fabric thereof is a substantially non-water receiving fabric,
wherein both said substantially non-water receiving fabric and said dense compression belt pass through said second extended nip,
wherein said substantially non-water receiving fabric has a permeability to air of about 0.1 to 2 $m^3/m^2$ min at a pressure difference of about 100 Pa or about 10 mm $H_2O$.

19. The combination of claim 18, wherein said permeability at said pressure difference of said fabric is up to about $0.5 m^3/m^2 min$.

* * * * *